US005139266A

United States Patent [19]

Mullins et al.

[11] Patent Number: 5,139,266

[45] Date of Patent: Aug. 18, 1992

[54] WORLD TOUR BOARD GAME

[76] Inventors: Maxey D. Mullins; Cristy R. Golden, both of 2050 Austell Rd., Apt. D-11, Marietta, Ga. 30060

[21] Appl. No.: 772,567

[22] Filed: Oct. 7, 1991

[51] Int. Cl.[5] ..... A63F 3/04; A63B 63/00; A63B 65/00

[52] U.S. Cl. ..... 273/240; 273/251; 273/402; 273/415; 273/138 R

[58] Field of Search ..... 273/290, 249-254, 273/243, 256, 145 B, 145 C, 145 A, 138, 402, 401, 400, 399, 398, 415

[56] References Cited

U.S. PATENT DOCUMENTS 3,994,499 11/1976 Barlow ..... 273/256
4,357,017 11/1982 Schneider ..... 273/246
4,923,201 5/1990 Nichol et al. ..... 273/415
4,930,789 6/1990 Harris et al. ..... 273/274
4,943,065 7/1990 DeLapa ..... 273/402

OTHER PUBLICATIONS

The Science Teacher, May 1981, p. 41.

*Primary Examiner*—Benjamin H. Layno
*Attorney, Agent, or Firm*—Hugh E. Smith

[57] ABSTRACT

A board game is designed to simulate taking a tour around the world. Money is spent on travel, lodging, shopping, food, and the like, and money is obtained by tossing beanbags through openings or by using a spinner. A variation of the game facilitates a changing of destinations and rules on each of the game board spaces by utilizing a marker and an erasable game board surface.

5 Claims, 4 Drawing Sheets

WORLD TOUR BOARD GAME

BACKGROUND OF THE INVENTION

1. Field of the Invention

The present invention relates to board games and more particularly pertains to a board game which simulates a world tour.

2. Description of the Prior Art

Travel simulating board games are well known in the prior art. Typical examples of these prior art games are to be found in U.S. Pat. No. 4,052,072 which is entitled "Educational World Map Game" and which issued to P. Beal on Oct. 4, 1977; U.S. Pat. No. 4,061,336 which is entitled "Geographic Board Game" and which issued to L. Lincoln on Dec. 6, 1977; U.S. Pat. No. 4,809,987 which is entitled "Board Game Apparatus Representing Destinations" and which issued to Dvorak et al on Mar. 7, 1989; U.S. Pat. No. 4,928,967 which is entitled "Map Board Game" and which issued to A. Woodliff on May 29, 1990; and U.S. Pat. No. 4,961,582 which is entitled "Geographical Travel Game" and which issued to S. Van Lysel on Oct. 9, 1990. As can be appreciated, all of these patents represent games which are functional for their intended purposes and which vary in rules and manner of play. Further, these patents are only representative of a far larger number of patents which could have been provided and accordingly, it should be recognized that travel board games comprise a crowded art whereby there is a constant interest in improvements by the consuming public. More particularly, the large number of travel board games now available are representative of the fact that little or no variation in rules of play are generally available to each board game and accordingly, there is a need for some method of varying the manner of play with respect to each board game, thereby to maintain user interest. Recognizing this need, the present invention provides for a new type of travel board game which allows a variable method of play.

SUMMARY OF THE INVENTION

In view of the foregoing disadvantages inherent in the known types of travel board games now present in the prior art, the present invention provides an improved travel board game construction wherein the same can be modified by the user to maintain player interest. As such, the general purpose of the present invention, which will be described subsequently in greater detail, is to provide a new and improved travel board game which has all the advantages of the prior art travel board games and none of the disadvantages.

To attain this, the present invention essentially comprises a board game which is designed to simulate taking a tour around the world. Money is spent on travel, lodging, shopping, food, and the like, and money is obtained by tossing beanbags through openings or by using a spinner. A variation of the game facilitates a changing of destinations and rules on each of the game board spaces by utilizing a marker and an erasable game board surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved travel board game which has all the advantages of the prior art travel board games and none of the disadvantages.

It is another object of the present invention to provide a new and improved travel board game which may be easily and efficiently manufactured and marketed.

It is a further object of the present invention to provide a new and improved travel board game which is of a durable and reliable construction.

An even further object of the present invention is to provide a new and improved travel board game which is susceptible of a low cost of manufacture with regard to both materials and labor, and which accordingly is then susceptible of low prices of sale to the consuming public, thereby making such travel board games economically available to the buying public.

Still yet another object of the present invention is to provide a new and improved travel board game which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
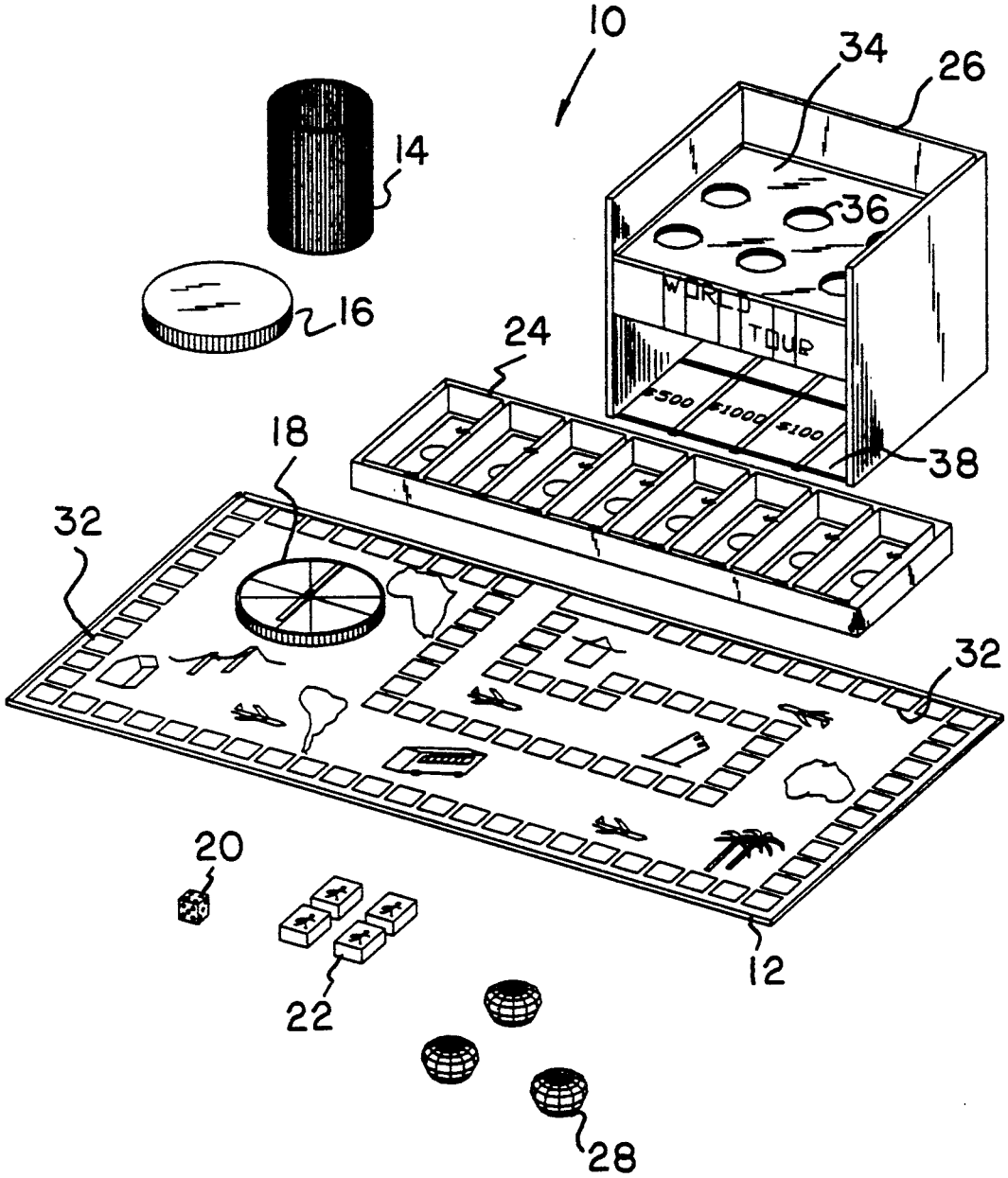
FIG. 1 is a perspective view of the entire game assembly comprising the present invention.
Figure 2:
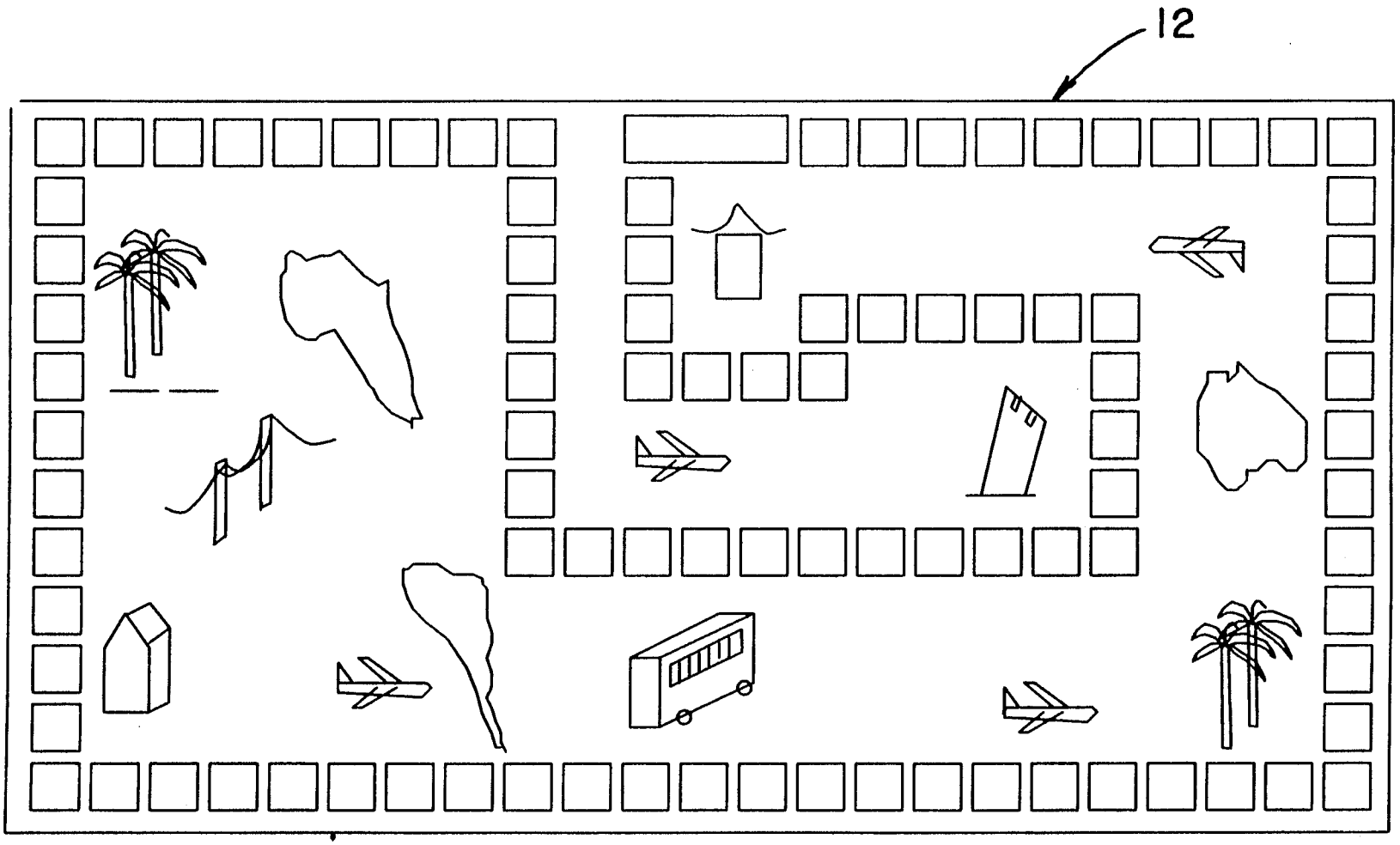
FIG. 2 is a top plan view of the erasable game board forming a part of the present invention.
Figure 3:
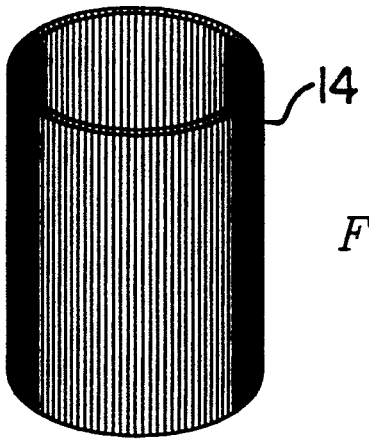
FIG. 3 is a perspective view of the dice shaker can forming a part of the present invention.
Figure 4:
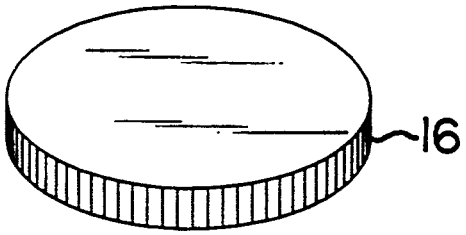
FIG. 4 is a perspective view of the shaker can cover forming a part of the present invention.
Figure 5:
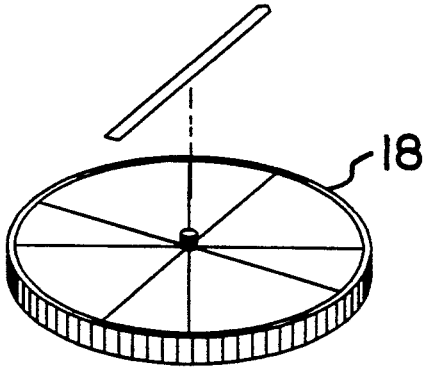
FIG. 5 is a perspective view of the spinner utilizable with the present invention.
Figure 6:
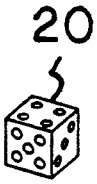
FIG. 6 is a perspective view of a die utilizable with the invention.
Figure 7:
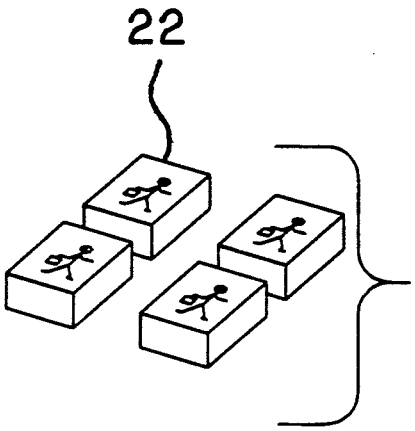
FIG. 7 is a perspective view of the game markers utilizable with the invention.
Figure 8:
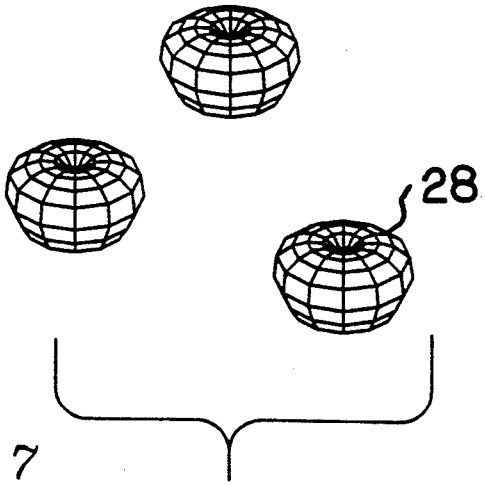
FIG. 8 is a perspective view of the beanbags utilizable with the present invention.
Figure 9:
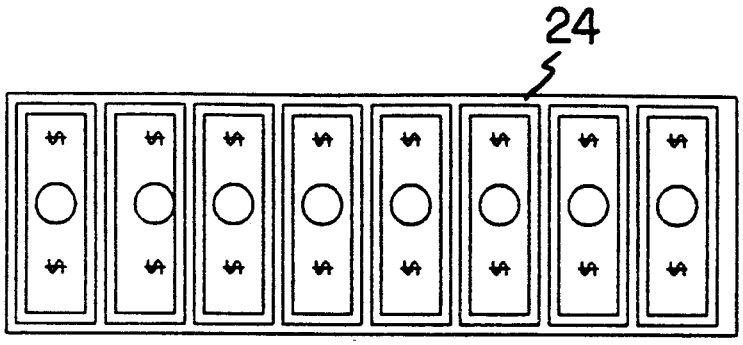
FIG. 9 is a top plan view of a money tray utilizable with the invention.
Figure 10:
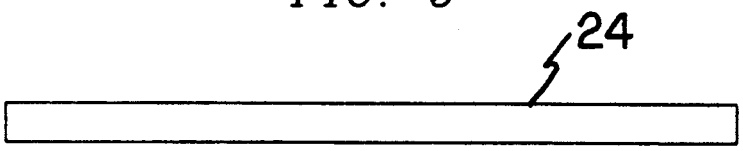
FIG. 10 is a front elevation view of the money tray.
Figure 11:
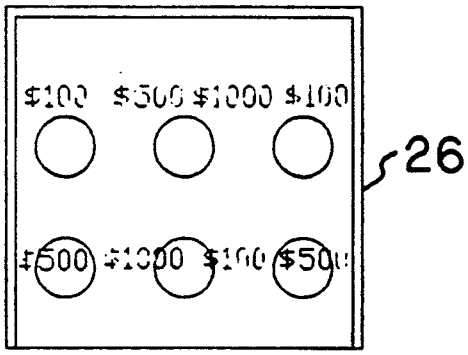
FIG. 11 is a top plan view of the toss box associated with the invention.
Figure 12:
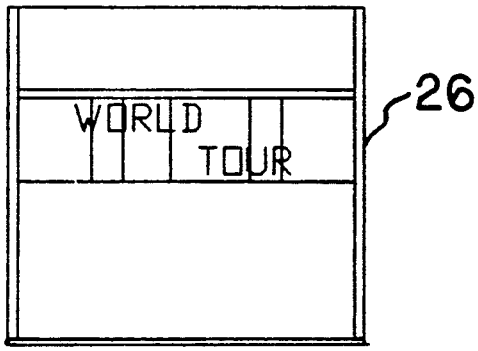
FIG. 12 is a front elevation view of the toss box.
Figure 13:
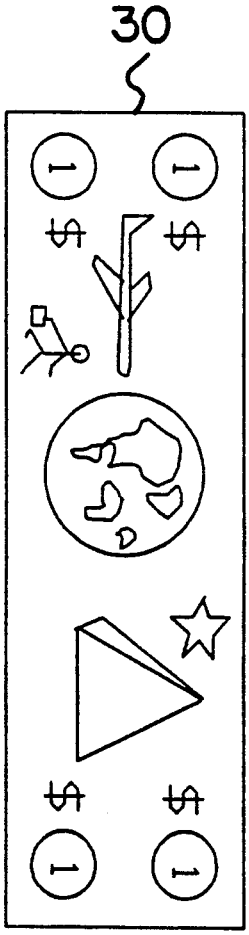
FIG. 13 is a top plan view the play money utilizable with the invention.

With reference now to the drawings, and in particular to FIGS. 1-13 thereof, a new and improved travel board game embodying the principles and concepts of the present invention and generally designated by the reference numeral 10 will be described.

More specifically, it will be noted that the game 10 includes a game board 12, a die shaker can 14, a cover for the can 16, a spinner 18, at least one die 20, and a plurality of game markers 22. Additionally, a money tray 24 is provided, as is a beanbag toss box 26 and a plurality of beanbags 28. A large quantity of play money 30 is also provided and is normally retained within the money tray 24.

The four game markers or tokens 22 should be four different colors (red, yellow, black, white), and the play money 30 should be provided in dollar denominations of 1, 5, 10, 20, 50, 100, 500 and 1000. The object of the game is for a player to travel around the world and return home with as much money as possible.

Initial setup of the game involves all of the players positioning their chosen tokens 22 on a selected start position on the game board 12. Each player should be provided with a total of 500 dollars and the money is distributed in dollar denominations as follows: two 100 dollar bills, two 50 dollar bills, five 20 dollar bills, five 10 dollar bills, eight 5 dollar bills, and ten 1 dollar bills.

The construction of the game board 12 is variable inasmuch as an erasable surface may be provided with an erasable ink pen then being utilized to choose what is written in each game space 32. Certain spaces 32 can cause a player to spend money on airline tickets, bus fares, taxicabs, motel rooms, general shopping, souvenirs and food. Other spaces 32 on the board can represent spots of visitation such as Los Angeles, San Francisco, Hawaii, Japan, China, India, France, Spain, Portugal, and then back home to the United States to Boston and then onto Fall River, Mass. where the game was invented. One anticipated spot on the board 12 (between India and France) involves the player's plane going down over Iraq whereby the player is taken hostage and two turns are lost.

With the intent of the game being to return home with as much money as possible, money can be gained during travel by using the spinner 18 or the toss box 26. The toss box 26 includes a top transparent tray 34 having a plurality of beanbag receiving apertures 36 and as will be observed, beanbags 28 can be tossed through selected apertures 36 so as to land on a bottom board 38 that defines denominations of money "won" by the player.

With respect to the basic rules for play, each player initially chooses a token 22 to represent him in the game. Each player, in turn, will roll the die 20 and the player with the lowest number will go first. The first player will then roll the die 20 and move his token 22 the number of spaces shown on the die. At this point, the player reads the space 32 where his token 22 has stopped and then follows the written instructions on that space. Again, all types of written instructions can be provided due to the erasable structure of the game board 12.

Play then resumes with the player to the left of the first player. If a player lands on a "toss" or "spin" space, he is entitled to choose between tossing the number of beanbags 28 stated through the holes 36 on the toss box 26, or he may spin the spinner 18 that number of times and receive the combined total of money thrown or spun. If a player chooses to toss a beanbag 28 and the toss misses, the player does not get to retoss. If his toss lands on top of the box so as to remain on the top tray 34, but does not fall through one of the apertures 36, he does get to re-toss the bag 28.

When a player reaches a "stop" space, he must stop and pay the amount shown on that space 32. The player may then continue on by re-tossing the die 20 and move that amount of spaces. If a player lands on any "pay" space, including "stop", and does not have enough money 30 to pay his bill, his turn ends. However, the player is entitled to one toss or spin per turn until he has earned enough money to proceed around the board on his following turn.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved travel board game comprising:

a game board having a plurality of spaces over which player tokens may move, said spaces representing locations and also providing instructions for players;

at least one token movable along said game board spaces;

a die for generating numbers representative of the number of spaces along which said token may move;

play money for handling expenses associated with said game;

a toss box comprising a top surface having a plurality of holes, and a bottom surface having indicia representing various monetary values, each hole corresponding to a monetary value indicia wherein each monetary value indicia is located directly underneath one of said holes at least one toss bag sized to pass through any one of said holes when thrown into said toss box to indicate an earned amount of said play money;

and a spinner having indicia representing monetary values thereon for also allowing a player to earn said play money.

2. The new and improved travel board game as described in claim 1, and further including a shaker cup into which said die may be positioned prior to being tossed upon a playing surface.

3. The new and improved travel board game as described in claim 2, wherein said game board utilizes an erasable surface whereby locations and instructions in said spaces may be selectively changed by a player, thereby to enhance player interest.

4. The new and improved travel board game as described in claim 3, and further including a closure for said shaker cup.

5. The new and improved travel board game as described in claim 4, and further including a money tray for holding said play money.

* * * * *